US006714206B1

(12) United States Patent
Martin et al.

(10) Patent No.: US 6,714,206 B1
(45) Date of Patent: Mar. 30, 2004

(54) METHOD AND SYSTEM FOR SPATIAL-TEMPORAL DITHERING FOR DISPLAYS WITH OVERLAPPING PIXELS

(75) Inventors: Russel A. Martin, Menlo Park, CA (US); Dale Adams, San Jose, CA (US); Duane Siemens, Mountain View, CA (US); Hugo Steemers, Mountain View, CA (US)

(73) Assignee: Silicon Image, Sunnyvale, CA (US)

( * ) Notice: Subject to any disclaimer, the term of this patent is extended or adjusted under 35 U.S.C. 154(b) by 227 days.

(21) Appl. No.: 10/016,247

(22) Filed: Dec. 10, 2001

(51) Int. Cl.[7] ..... G09G 5/02

(52) U.S. Cl. ..... 345/589; 345/596; 345/605; 345/597; 345/600; 345/690; 345/694; 345/695; 358/518; 358/519; 358/520

(58) Field of Search ..... 345/589, 596, 345/605, 597, 600, 690, 694, 695; 358/518, 519, 520

(56) References Cited

U.S. PATENT DOCUMENTS 5,298,915 A * 3/1994 Bassetti, Jr. ..... 345/696
5,313,224 A 5/1994 Singhal et al.
5,469,190 A * 11/1995 Masterson ..... 345/605
5,734,363 A * 3/1998 Blouin et al. ..... 345/89
6,008,794 A 12/1999 Ishii
6,184,854 B1 * 2/2001 Hotto et al. ..... 345/89
6,362,834 B2 * 3/2002 Ishii ..... 345/690
2002/0005854 A1 * 1/2002 Deering et al. ..... 345/596
2003/0103059 A1 * 6/2003 Correa et al. ..... 345/596

OTHER PUBLICATIONS (ClairVoyante Laboratories, Inc.), "What is PenTile Matrix™?," 1999, 4 pages; www.clairvoyante.com/what.html (downloaded Oct. 29, 2001).

* cited by examiner

*Primary Examiner*—Matthew C. Bella
*Assistant Examiner*—Manucher Rahmjoo
(74) *Attorney, Agent, or Firm*—Perkins Coie LLP

(57) ABSTRACT

A method and system for establishing intensity levels for sub-pixels of a display device with overlapping logical pixels. The dithering system combines frame rate control techniques with contributions from overlapping pixels to establish the intensity level of each sub-pixel. The dithering system initially provides an assignment of frame numbers to each sub-pixel. The dithering system then receives a logical pixel color that includes an intensity value for each component color (e.g., red, green, and blue) for each logical pixel. The dithering system maps each component intensity value of each logical pixel to an intensity value with a low depth plus a remainder. The dithering system generates a sub-pixel intensity value for each sub-pixel of each logical pixel using frame rate control to adjust the intensity value of each sub-pixel based on the remainder and current frame number. The dithering system then calculates the intensity value for a sub-pixel by combining all the generated sub-pixel intensity values for that sub-pixel.

31 Claims, 14 Drawing Sheets

1001 RG Value

| | 0 | 1 | 2 | 3 | 4 | 5 | ... |
|---|---|---|---|---|---|---|---|
| 0 | | | | | | | |
| 1 | | | | | | | |
| 2 | | | | | | | |
| 3 | | | | | | | |
| ... | | | | | | | |

1002 B Value

| | 0 | 1 | 2 | 3 | 4 | 5 | ... |
|---|---|---|---|---|---|---|---|
| 0 | | | | | | | |
| 1 | | | | | | | |
| 2 | | | | | | | |
| 3 | | | | | | | |
| ... | | | | | | | |

1003 RG Number

| | 0 | 1 | 2 | 3 | 4 | 5 | ... |
|---|---|---|---|---|---|---|---|
| 0 | 2 | 3 | 1 | 4 | 2 | 3 | |
| 1 | 2 | 3 | 1 | 4 | 2 | 3 | |
| 2 | 1 | 4 | 2 | 3 | 1 | 4 | |
| 3 | 1 | 4 | 2 | 3 | 1 | 4 | |
| ... | | | | | | | |

1004 B Number

| | 0 | 1 | 2 | 3 | 4 | 5 | ... |
|---|---|---|---|---|---|---|---|
| 0 | 1 | 3 | 1 | 3 | 1 | 3 | |
| 1 | 4 | 2 | 4 | 2 | 4 | 2 | |
| 2 | 1 | 3 | 1 | 3 | 1 | 3 | |
| 3 | 4 | 2 | 4 | 2 | 4 | 2 | |
| ... | | | | | | | |

*Fig. 10*

METHOD AND SYSTEM FOR SPATIAL-TEMPORAL DITHERING FOR DISPLAYS WITH OVERLAPPING PIXELS

BACKGROUND

The described technology relates to setting intensity levels for sub-pixels of displays with overlapping logical pixels.

Active matrix liquid crystal displays have become very popular for computer monitors and televisions. These liquid crystal displays typically have pixels that each contains a red, a green, and a blue stripe. These pixels are referred to as an "RGB stripe pixel." Each stripe of a pixel is referred to as a "sub-pixel." The image quality of these liquid crystal displays varies depending on the density of pixels and the number of intensity levels supported by the display. These liquid crystal displays typically use either 6 bits per sub-pixel or 8 bits per sub-pixel to represent intensity levels. The number of bits per sub-pixel is referred to as the "pixel depth." With 6 bits per pixel, 262,144 colors can be displayed, and with 8 bits per pixel, almost 17 million colors can be displayed. Although the quality of images produced from a display that uses 8 bits per pixel is much higher than from a display that uses 6 bits per pixel, the cost of a display that uses 8 bits per pixel is significantly higher.

Spatial dithering has traditionally been used to improve the image quality of displays that use lower depth pixels. Spatial dithering typically involves mapping intensity values of a higher depth (e.g., 8 bits per sub-pixel) to intensity values of a lower depth (e.g., 6 bits per sub-pixel). When mapping from 8 to 6 bits per sub-pixel, the range of intensity values is reduced from 256 to 64. In such a case, four different 8-bit intensity values map to each 6-bit intensity value. For example, the 8-bit intensity values of 32, 33, 34, and 35 may map to a 6-bit intensity value of 8. The mapping from an 8-bit intensity value to a 6-bit intensity value is typically performed by dividing the 8-bit intensity value by 4, which leaves a remainder of 0 to 3. The remainder represents a loss of image quality that results from the mapping. With spatial dithering, the display may be divided into super-pixels comprising 4 pixels each, and the intensity values of the pixels within a super-pixel are adjusted based on the remainder. For example, if the 8-bit intensity value is 33, then the 6-bit intensity value is 8 with a remainder of 1. Because the remainder is 1, one of the pixels of a super-pixel is set to an intensity value of 9, and the other three pixels of the super-pixel are set to an intensity value of 8. Since the pixels are small and close together, the eye perceives the dithered super-pixel with one intensity value of 9 and three intensity values of 8 as very similar to the intensity value of 33 with a depth of 8 bits.

In order to improve the image quality of a liquid crystal display that displays color with a lower depth than can be provided to the display, various other dithering techniques have been used. One such class of dithering techniques is referred to as "frame rate control" ("FRC"). Frame rate control techniques use both "temporal dithering" and "spatial dithering," which can take advantage of the slow response time of liquid crystals to small changes in applied voltage. Temporal dithering refers to dithering from one frame to the next as opposed to dithering within a single frame. (A typical display may display 30 or 60 frames per second.) With frame rate control, a single pixel may have its intensity value varied from one frame to the next to account for the loss of depth. For example, if the 8-bit intensity value of 33 is mapped to a 6-bit intensity value of 8 with a remainder of 1, then a pixel may have its intensity value set to 9 during every fourth frame and set to 8 during the remaining 3 frames. Thus, temporal dithering tends to approximate the 8-bit intensity value over time, rather than over space. Frame rate control uses a combination of dithering techniques by defining a super-pixel or pattern of pixels to indicate which pixels should have their intensity levels increased from one frame to the next. For example, if a super-pixel comprises 4 pixels, then an 8-bit intensity value of 33 can be approximated by setting the intensity value of the first pixel of the super pixel to 9 and setting the intensity value of all other pixels to 8 during the first frame, by setting the intensity value of the second pixel of the super-pixel to 9 and setting the intensity value of all other pixels to 8 during the second frame, and so on. Thus, the super-pixel approximates the 8-bit intensity value using both temporal and spatial dithering.

Because the eye can differentiate the colors of a green and red to a greater degree than the color blue, different types of striping techniques have been developed. One such technique, referred to as a "split stripe," divides the green and the red stripe of an RGB striped pixel into two, leaving 5 sub-pixels: 2 vertically aligned green sub-pixels, 2 vertically aligned red sub-pixels and 1 blue sub-pixel positioned in between the red and the green sub-pixels. The image quality can be improved by independently setting each red and green sub-pixel within a pixel to a different intensity level. Another technique, referred to as "Pentile tiling," exchanges the position of a red and green sub-pixel of the split stripe pixel so that sub-pixels of the same color are no longer vertically aligned but are instead diagonally aligned. Another form of Pentile tiling is to replace the rectangular striped sub-pixels with different shaped sub-pixels. FIG. 1 is a diagram illustrating a form of Pentile tiling. Pixel 100 includes 5 sub-pixels 101–105. Sub-pixels 101 and 103 display the color red, sub-pixels 102 and 104 display the color green, and sub-pixel 105 displays the color blue.

When the Pentile pixels of FIG. 1 are arranged in a matrix, the colors are usually specified using logical pixels, rather than physical pixels. A logical pixel is generally defined as a group of adjacent sub-pixels that may include sub-pixels from different physical pixels. A logical pixel is typically a center sub-pixel and its surrounding sub-pixels. The intensity value of a sub-pixel of a display is generally set based on intensity values of its surrounding logical pixels that are weighted according to their location relative to the sub-pixel. FIG. 2 illustrates a logical pixel of a Pentile matrix of pixels. The pixel 100 in FIG. 1 illustrates what is commonly referred to as a physical pixel. The Pentile matrix 200 shows 6 physical pixels 201–206 that are each centered on a blue sub-pixel. A logical pixel of a Pentile matrix, in contrast, may be centered on each red sub-pixel and each green sub-pixel. A logical pixel of the Pentile matrix may be defined as a center sub-pixel, the adjacent blue sub-pixel, and the four adjacent sub-pixels with a color different from the center sub-pixel. Logical pixel 207 is illustrated with a bold line drawn around it. The center of the logical pixel is red sub-pixel 208, and it is adjacent to the blue sub-pixel 209 and to the four green sub-pixels 210–213. Thus, the sub-pixels 208–213 form logical pixel 207. Green sub-pixels 210–213 are centers of logical pixels that each include sub-pixel 208. FIGS. 3–6 illustrate logical pixels of the Pentile matrix that overlap a common sub-pixel. In FIG. 3, logical pixel 214 is centered on green sub-pixel 210. As can be seen, logical pixel 214 includes red sub-pixel 208. Thus, logical pixel 207 and logical pixel 214 overlap. (Actually, logical pixels 207 and 214 each contain sub-pixels 208, 209, and 210 in common.) In FIGS. 4–6, logical pixels 221, 228, and 235 are illustrated as overlapping the center sub-pixel 208 of logical pixel 207. Thus, sub-pixel 208 is included in logical pixels 207, 214, 221, 228, and 235.

According to one technique, when generating the intensity value for a sub-pixel of a logical pixel, the intensity values of the logical pixels that include that sub-pixel are combined. Each red sub-pixel and green sub-pixel is included in 5 logical pixels, and each blue sub-pixel is included in 4 logical pixels. To calculate the intensity value for a red or green sub-pixel, one technique adds 50 percent of the intensity value of the logical pixel centered at the sub-pixel and 12.5 percent of the intensity value of each of the other four logical pixels that include that sub-pixel. The 50 percent and the 12.5 percent are referred to as a "contribution factor." For example, if the sub-pixel is red and the red intensity value of the RGB value for the logical pixel for which the sub-pixel is center is 64, then that logical pixel contributes 32 (i.e., 50 percent of 64) to the sub-pixel intensity value. If the other four overlapping logical pixels each have a red intensity value of 24, then 3 (i.e., 12.5 percent of 24) is added for each of the overlapping logical pixels. That is, 12 is added to 32 to result in an intensity value of 44 for the sub-pixel. Thus, each of the 5 logical pixels that contain a sub-pixel contributes to the intensity value of the sub-pixel of the display.

Although the use of a Pentile matrix with logical pixels may allow for improved image quality, it would be desirable to further improve such image quality.

BRIEF DESCRIPTION OF THE DRAWINGS

FIG. 10 illustrates data structures used to illustrate the dithering system.

DETAILED DESCRIPTION

A method and system for establishing intensity levels for sub-pixels of a display device with overlapping logical pixels is provided. In one embodiment, the dithering system combines frame rate control techniques with contributions from overlapping pixels to establish the intensity level of each sub-pixel. The dithering system initially provides an assignment of frame numbers to each sub-pixel to indicate the frame during which the intensity value of the sub-pixel is to be increased. The dithering system then receives a logical pixel color that includes an intensity value for each component color (e.g., red, green, and blue) for each logical pixel. Each received intensity value has a high depth (e.g., 8 bits). The dithering system maps each component intensity value of each logical pixel to an intensity value with a low depth (e.g., 6 bits) plus a remainder (e.g., 2 bits). The dithering system then generates a sub-pixel intensity value for each sub-pixel of each logical pixel using frame rate control to adjust the intensity value of a sub-pixel based on the remainder, the assigned frame number, and the current frame number. For example, in the case of a Pentile display, each of 5 logical pixels would include a generated intensity value that will contribute to the final intensity value of a sub-pixel that is included in each of the 5 logical pixels. The dithering system calculates the final intensity value for a sub-pixel by combining all the generated sub-pixel intensity values for that sub-pixel (i.e., one for each logical pixel that contains that sub-pixel). For example, in the case of a Pentile display, each red sub-pixel and green sub-pixel is a combination of 5 sub-pixel intensity values of the overlapping logical pixels. By combining frame rate control with overlapping logical pixels, a significantly improved image quality can be achieved.

Figure 1:
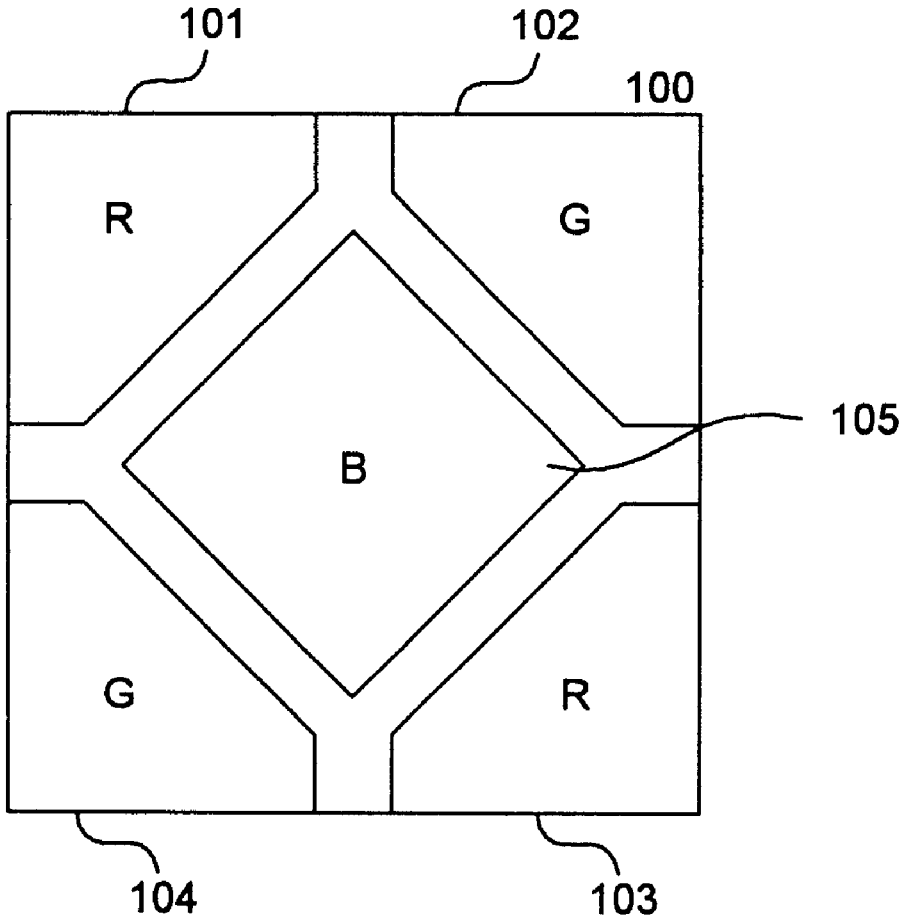
FIG. 1 is a diagram illustrating a form of Pentile tiling.
Figure 2:
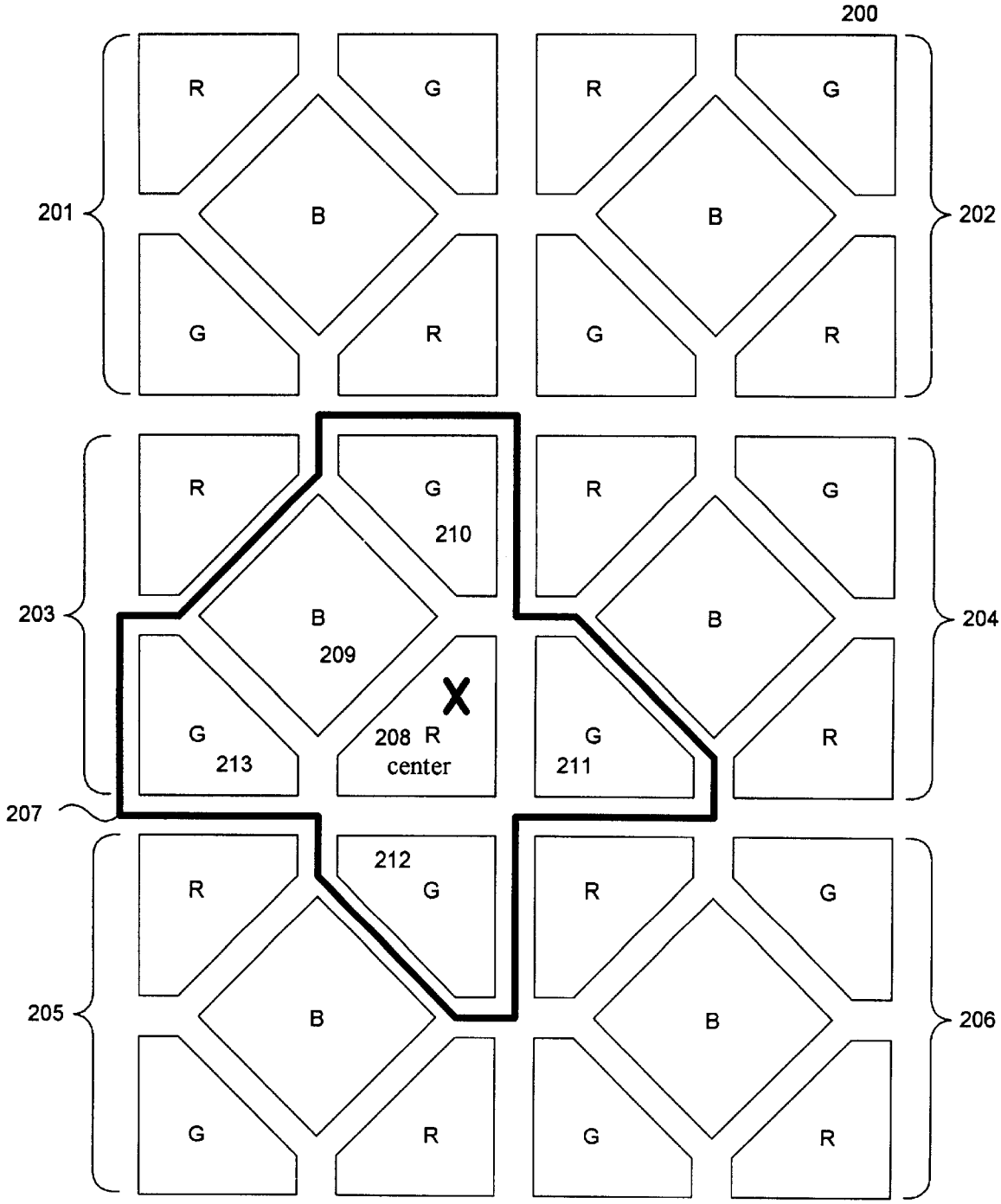
FIG. 2 illustrates a logical pixel of a Pentile matrix of pixels.
Figure 3:
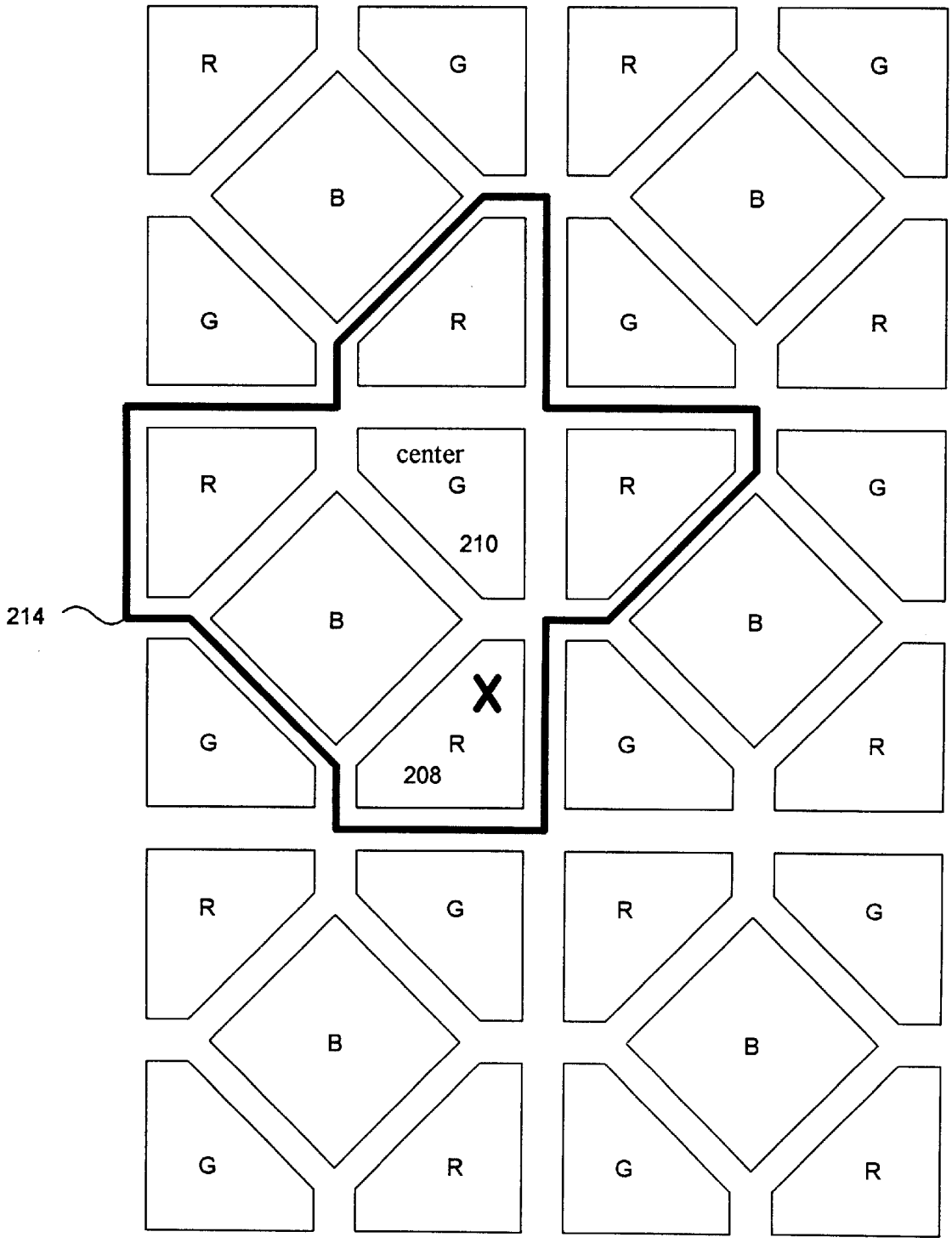
FIGS. 3–6 illustrate logical pixels of the Pentile matrix that overlap a common sub-pixel.
Figure 4:
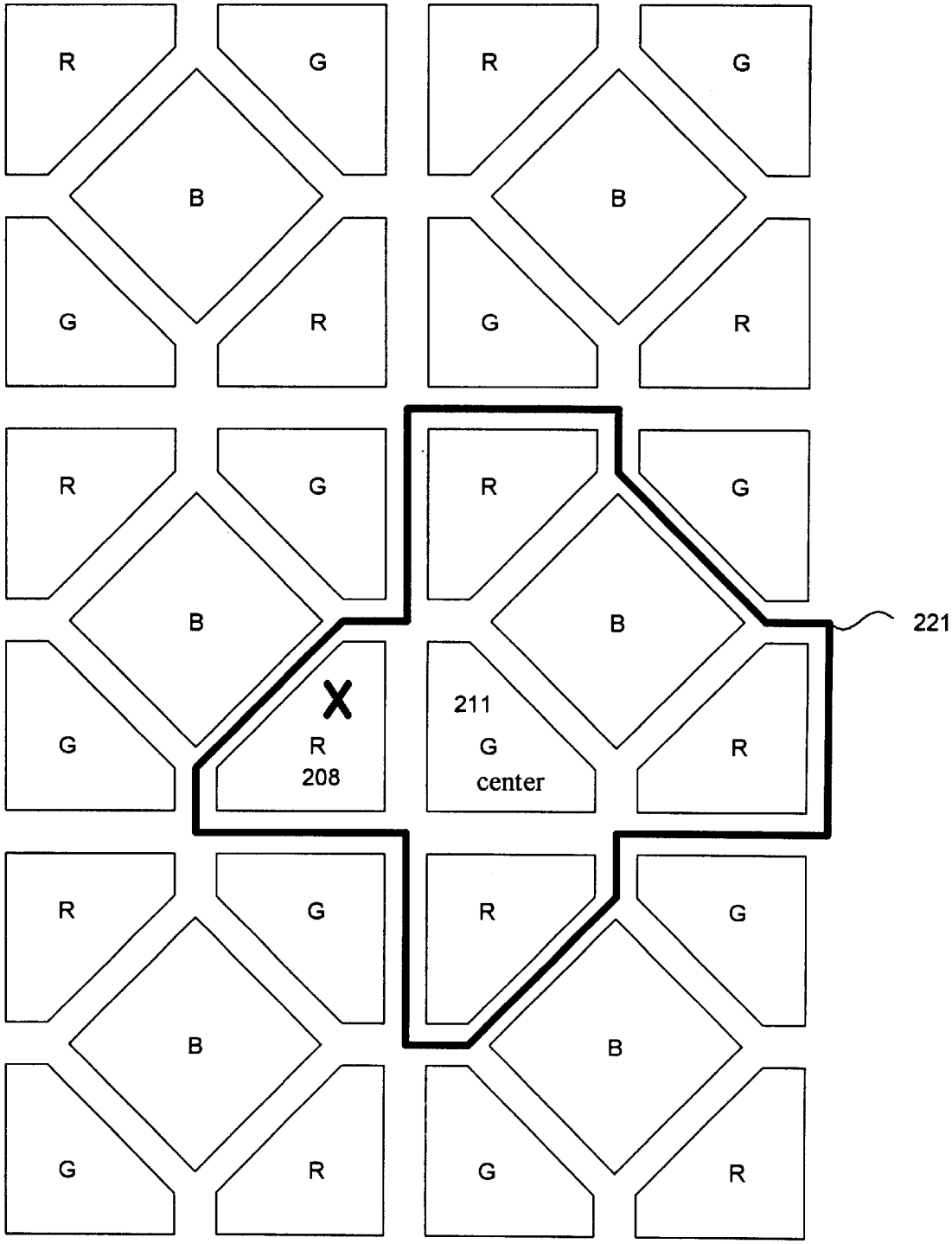
Figure 5:
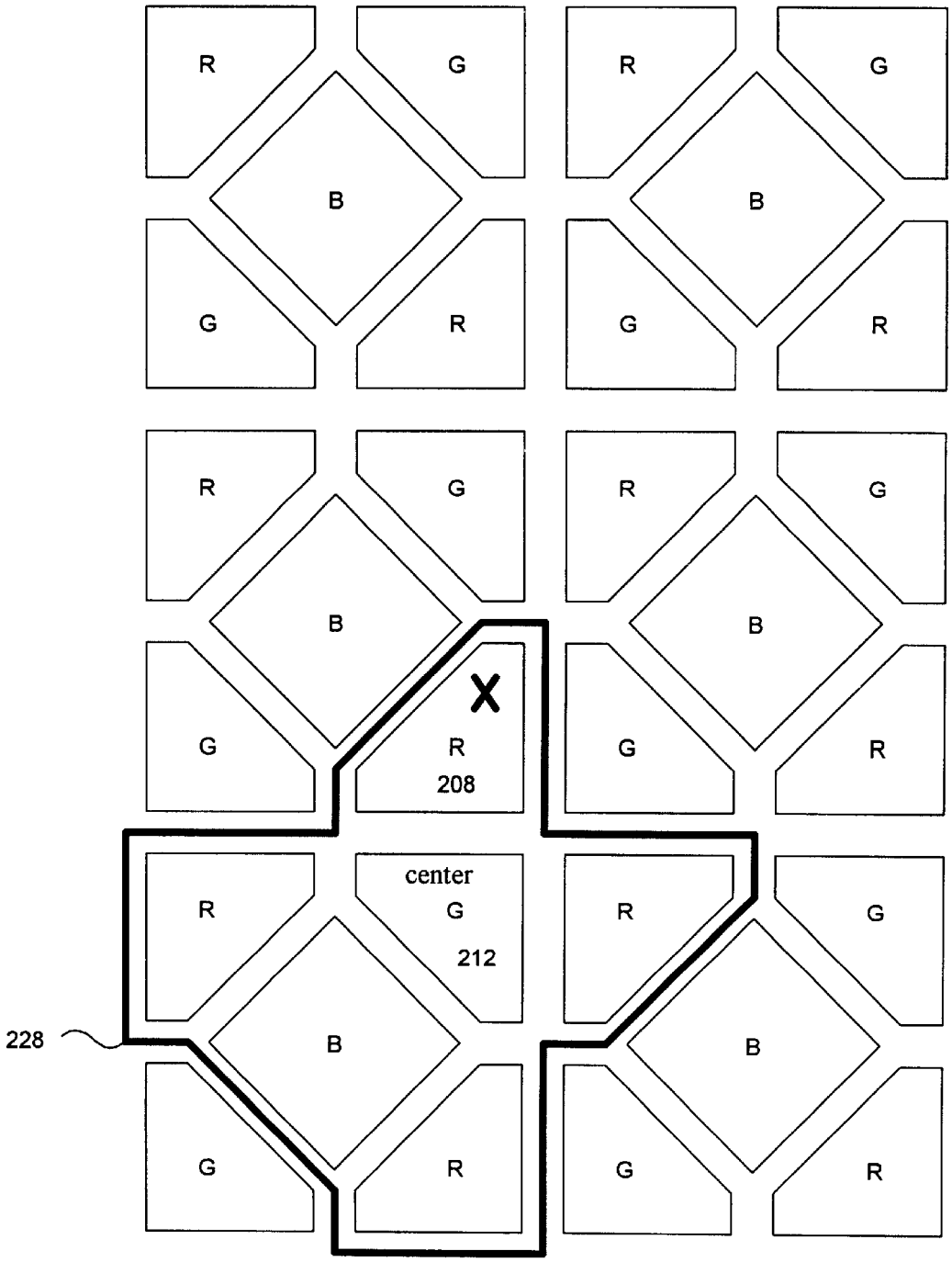
Figure 6:
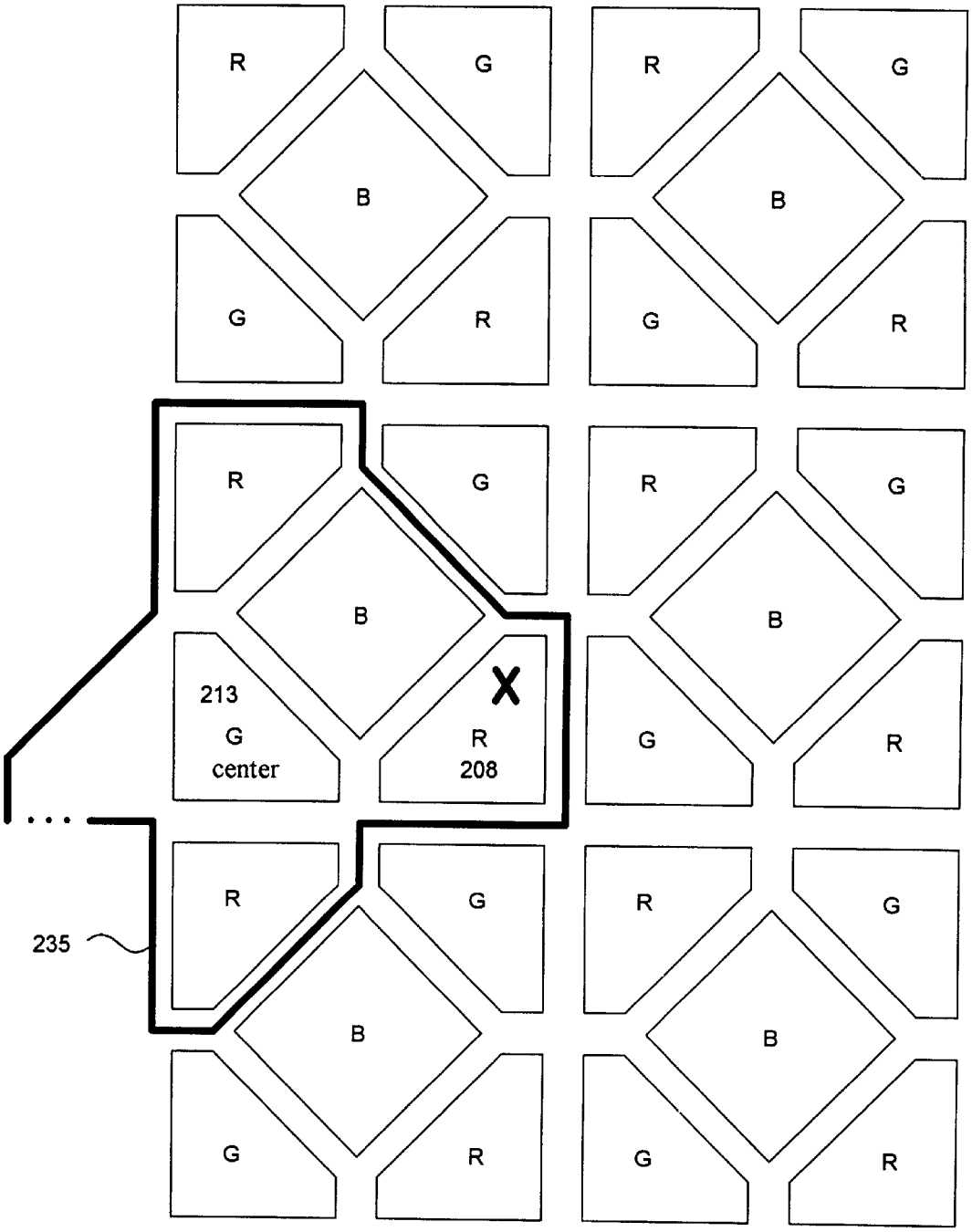
Figure 7A:
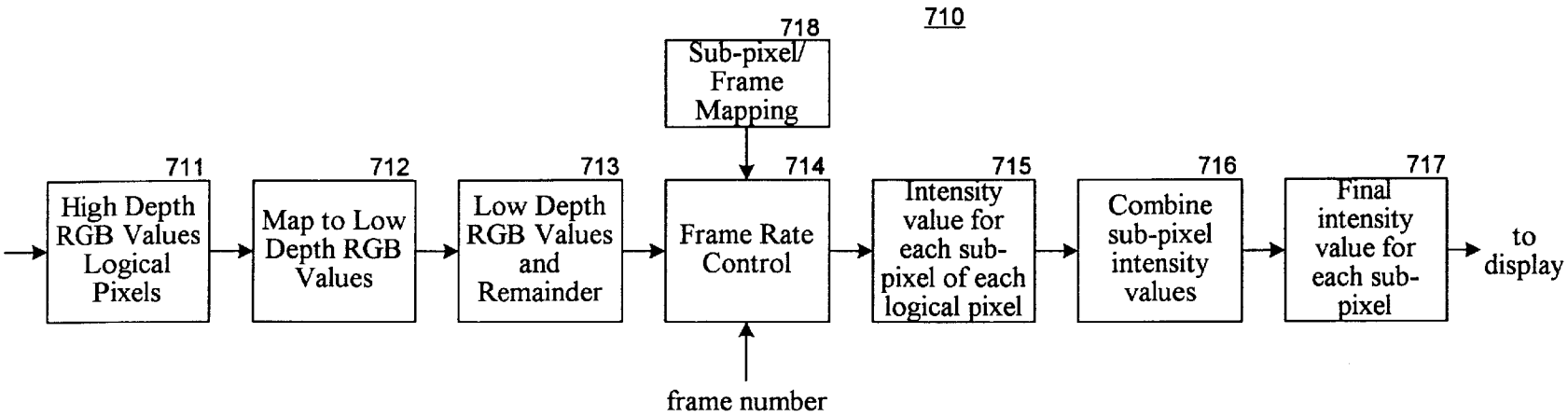
FIGS. 7A and 7B are block diagrams illustrating variations in the process of generating the intensity values for display sub-pixels.
Figure 7B:
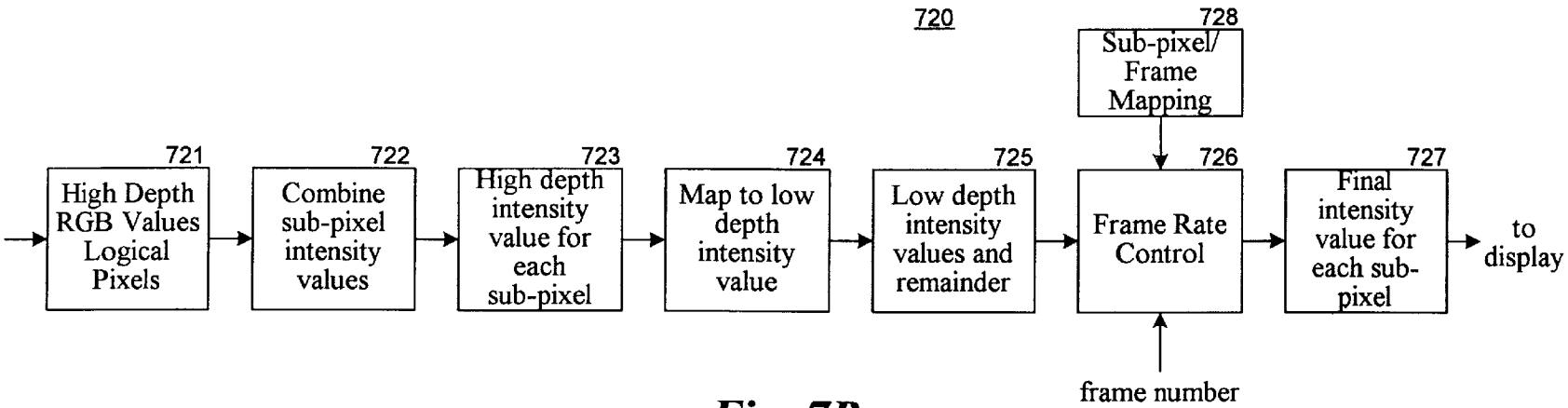

FIGS. 7A and 7B are block diagrams illustrating variations in the process of generating the intensity values for display sub-pixels. FIG. 7A illustrates applying frame rate control processing before combining the intensity values of logical pixels, and FIG. 7B illustrates combining the intensity values of logical pixels before applying frame rate control processing. Dithering system 710 includes components 711–718 in which frame rate control processing is applied before the intensity values are combined. The components either perform processing or store intensity values. Component 711 contains the input high-depth intensity values for each logical pixel. Component 712 maps the high-depth intensity values of each logical pixel to low-depth intensity values plus remainders, which are stored in component 713. Component 714 performs frame rate control on the low-depth intensity values and remainders using the sub-pixel frame mappings or assignments of component 718 and the current frame number. Component 715 contains the intensity value for each sub-pixel of a logical pixel. Component 716 calculates the final intensity value for each sub-pixel of the display by combining the sub-pixel intensity values of the logical pixels that contain that sub-pixel and stores the results in component 717. Dithering system 720 includes components 721–728 in which the intensity values of the logical pixels are combined before frame rate control processing is applied. Component 721 contains the input high-depth intensity values for each logical pixel. Component 722 combines the high-depth intensity values of the logical pixels to generate a combined high-depth intensity value for each sub-pixel of the display and stores the result in component 723. Component 724 maps the high-depth intensity value of each sub-pixel of the display to a low-depth intensity value plus remainder, which are stored in component 725. Component 726 performs frame rate control processing on the low-depth intensity values and remainders using the sub-pixel frame mapping of component 728 and the current frame number, and stores the final intensity values in component 727. One skilled in the art will appreciate that the processing components may operate in a pipelined manner and that the storage components may only store a portion of the intensity values at a time as needed by the pipelined components. In addition, the dithering techniques can be used with any number of bits in the low and high depths. For example, the high depth may be 9 bits and the low depth may be 6 bits, or the high depth may be 10 bits and the low depth may be 8 bits. The dithering techniques may also be used with color systems other than RGB-based systems. For example, the color system may be a CMY-based (i.e., cyan, magenta, and yellow) system, or any color system based on combinations of colors, especially primary colors.

In the following, aspects of the dithering system are described using block diagrams and logic or flow diagrams. One skilled in the art will appreciate that the dithering system can be implemented using different combinations of logic circuits and/or firmware. In particular, the logic diagrams illustrate processing that may be performed in parallel using duplicate logic circuits (e.g., one logic circuit for each logical pixel or for each sub-pixel of a display) or may be performed in serial using a single logic circuit. The particular logic designs can be tailored to meet the cost and performance objectives of the implementation of the dithering system. One skilled in the art will be able to readily design logic circuits based on the following descriptions.

Figure 8:
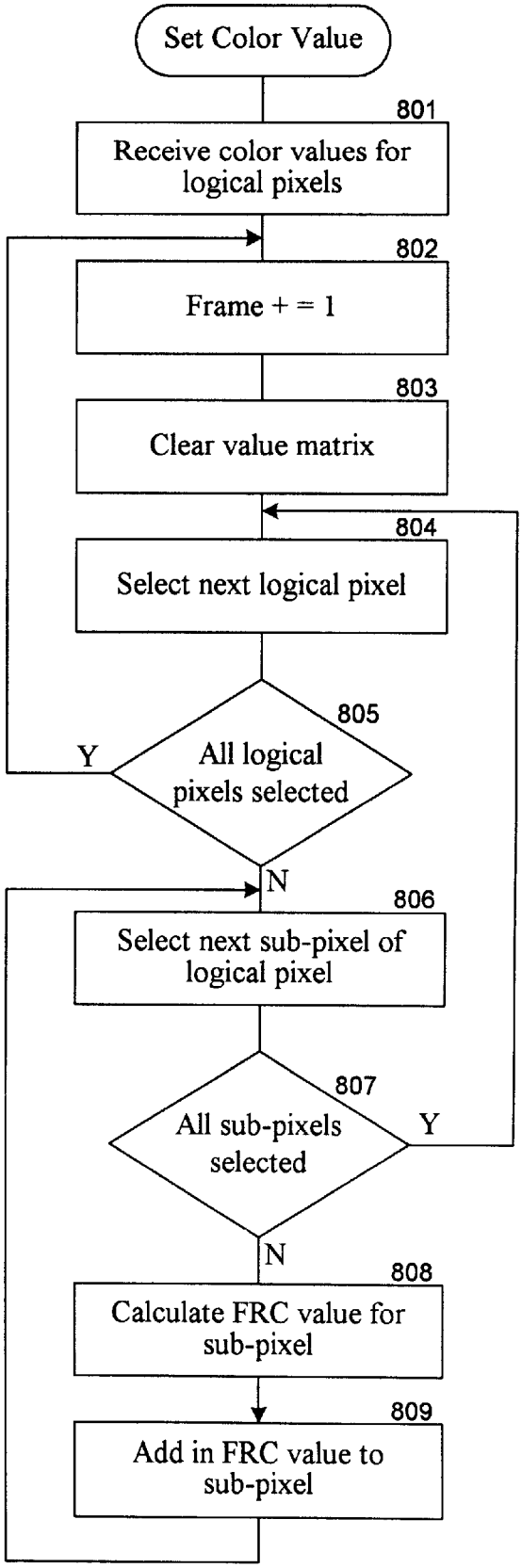
FIG. 8 is a flow diagram illustrating the overall processing of an algorithm of the dithering system that applies frame rate control to overlapping pixels.

In the following, an embodiment of the dithering system is described in which frame rate control processing is performed before combining the intensity values of logical pixels. FIG. 8 is a flow diagram illustrating the overall processing of an algorithm of the dithering system that applies frame rate control to overlapping pixels. In block 801, the system receives the color intensity values for the logical pixels of a display. In blocks 802–809, the system loops calculating the sub-pixel intensity values for each display frame. In block 802, the system increments the current frame number. In block 803, the system clears an intensity value matrix. The intensity value matrix accumulates an intensity value for each sub-pixel of the display. In blocks 804–809, the system loops selecting each logical pixel and aggregating that logical pixel's contribution to the sub-pixels of the display. In block 804, the system selects the next logical pixel starting with the first. In decision block 805, if all the logical pixels have already been selected, then the intensity value matrix contains the final intensity values and the system loops to block 802 to process the next frame, else the system continues at block 806. In blocks 806–809, the system selects each sub-pixel of the selected logical pixel and adds its contribution to the intensity value matrix. In block 806, the system selects the next sub-pixel of the selected logical pixel. In decision block 807, if all the sub-pixels of the selected logical pixel have already selected, then the system loops to block 804 to select the next logical pixel, else the system continues at block 808. In block 808, the system calculates a frame rate control value for the selected sub-pixel. In block 809, the system adds the calculated frame rate control value adjusted by a contribution factor to the intensity value for the corresponding sub-pixel in the intensity value matrix. The system then loops to block 806 to select the next sub-pixel of the selected logical pixel.

Figure 9A:
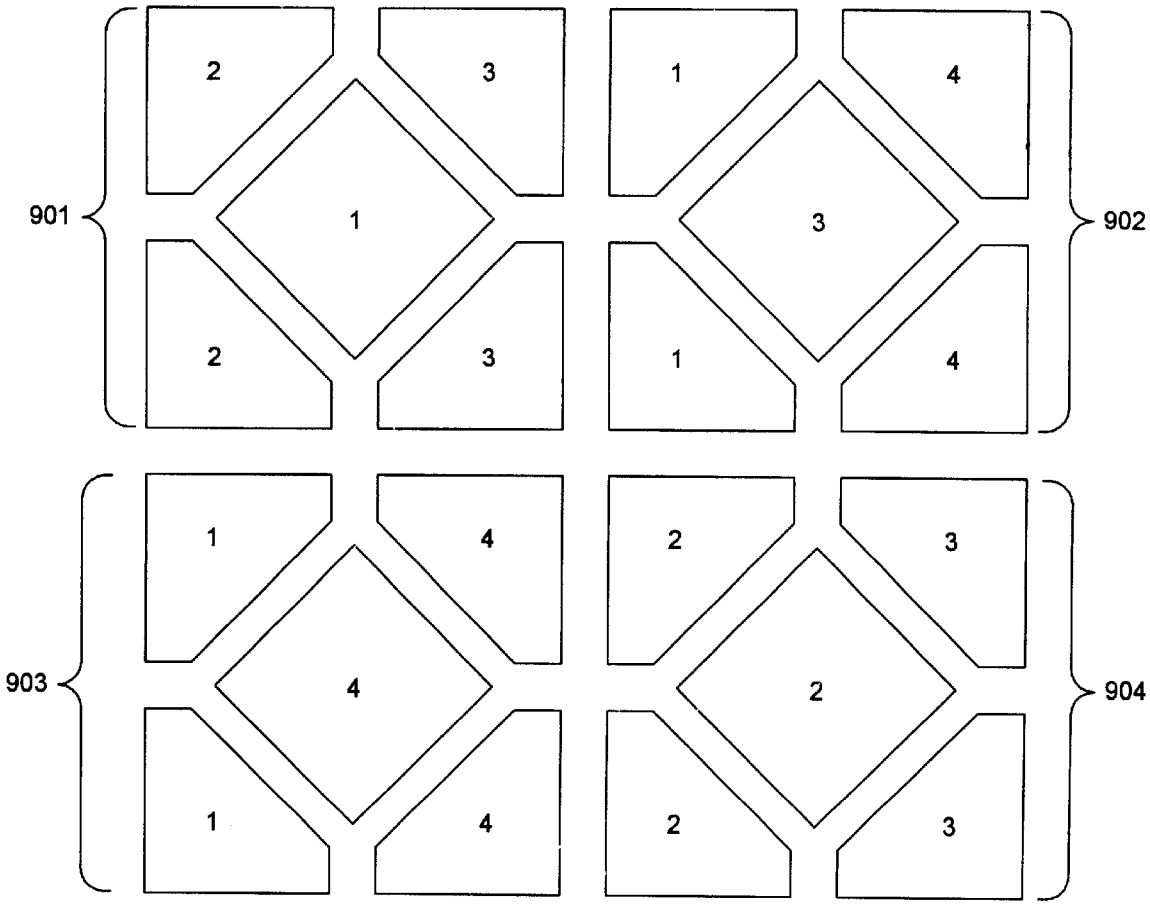
FIG. 9A is a diagram illustrating a mapping of sub-pixels of a Pentile matrix to frame numbers.

FIG. 9A is a diagram illustrating a mapping of sub-pixels of a Pentile matrix to frame numbers. In one embodiment, the frame numbers are established in a 2-by-2 pattern of 4 physical pixels. In this example, the frame number for each physical pixel 901, 902, 903, and 904 is predefined. One skilled in the art will appreciate that the frame numbers can also be assigned dynamically. A frame number indicates during which of 4 successive frames the sub-pixel will have its intensity value increased depending on the remainder. Each of the 4 blue sub-pixels of the pattern contain a different frame number, 2 of the 8 red sub-pixels each have a different frame number, and 2 of the 8 green sub-pixels each have a different frame number. If the remainder is 1 for a 6-bit intensity value for the color blue, for example, then the intensity value of the blue sub-pixel with a frame number of 1 would be increased during the first frame, the intensity value of the blue sub-pixel with a frame number of 2 would be increased during the second frame, and so on. One skilled in the art will appreciate that different pattern sizes and different frame assignments or mappings can be used to achieve the desired visual appearance. It may be preferred to uniformly distribute the frame numbers spatially. Also, the patterns and frame numbers may be selected based on the specific intensity values to be displayed (e.g., to avoid matching patterns in the data). Patterns and frame number assignments may also be randomly generated. The temporal span may include any number of frames and is not necessarily limited to 4 frames or consecutive frames.

Figure 9B:
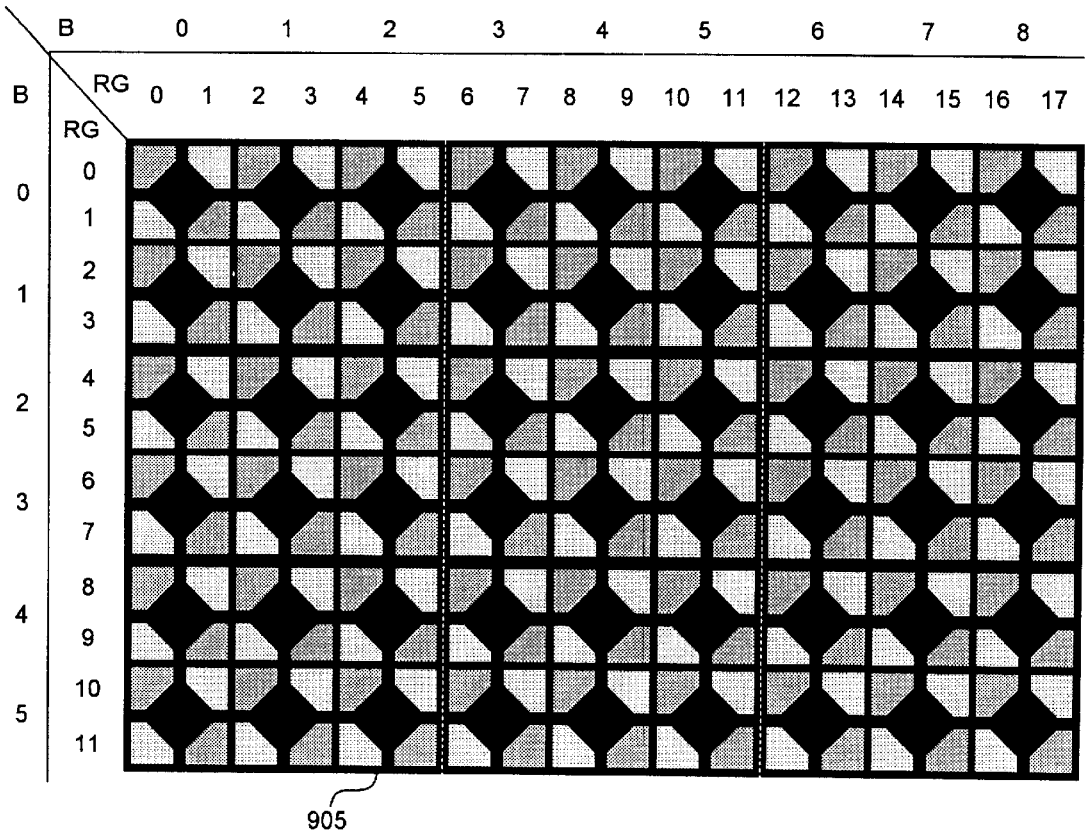
FIG. 9B is a diagram illustrating the indexing of sub-pixels that is used in the following algorithm to identify each sub-pixel of a display.

FIG. 9B is a diagram illustrating the indexing of sub-pixels that is used in the following algorithm to identify each sub-pixel of a display. The red and green sub-pixels that are horizontally aligned each have the same row index, and the red and green sub-pixels that are vertically aligned each have the same column index. For example, the upper left sub-pixel of physical pixel 905 has a row index of 10 and a column index of 4. The blue sub-pixels that are horizontally aligned each have the same row index, and the blue sub-pixels that are vertically aligned each have the same column index. For example, the blue sub-pixel of physical pixel 905 has a row index of 5 and a column index of 2. More generally, the indexes of a blue sub-pixel can be derived from the indexes of each of the red and green sub-pixels of the same physical pixel. In particular, the corresponding row index for a blue sub-pixel is the floor of the row index divided by 2 of any sub-pixel of that same physical pixel. For example, the row index for the blue sub-pixel of physical pixel 905 can be derived from the row index of the lower right sub-pixel of that physical pixel. The row index of the lower right sub-pixel is 11. Therefore, the row index of the blue sub-pixel is the floor of 11 divided by 2, which is 5.

FIG. 10 illustrates data structures used to illustrate the dithering system. Data structure 1001 is an RGvalue matrix that contains the intensity values for the red and green sub-pixels of a display. The dithering system accumulates the contributions of the logical pixels into the corresponding entry of the RGvalue matrix. Upon completion of the algorithm for a frame, the RGvalue matrix contains the final intensity value for each red sub-pixel and each green sub-pixel of the display. Data structure 1002 is a Bvalue matrix that contains the intensity values for the blue sub-pixels of a display. The dithering system accumulates contributions of logical pixels into the corresponding entry of the Bvalue matrix. Upon completion of the algorithm for a frame, the Bvalue matrix contains the final intensity value for each blue sub-pixel of the display. Data structure 1003 is an RGnumber matrix that contains the frame number for each red sub-pixel and each green sub-pixel of the display. In this example, the RGnumber matrix contains the frame numbers corresponding to the frame number values of FIG. 9A. Data structure 104 is a Bnumber matrix that contains the frame number for each blue sub-pixel of the display. In this example, the Bnumber matrix contains the frame numbers corresponding to the frame number values of FIG. 9A.

Figure 11:
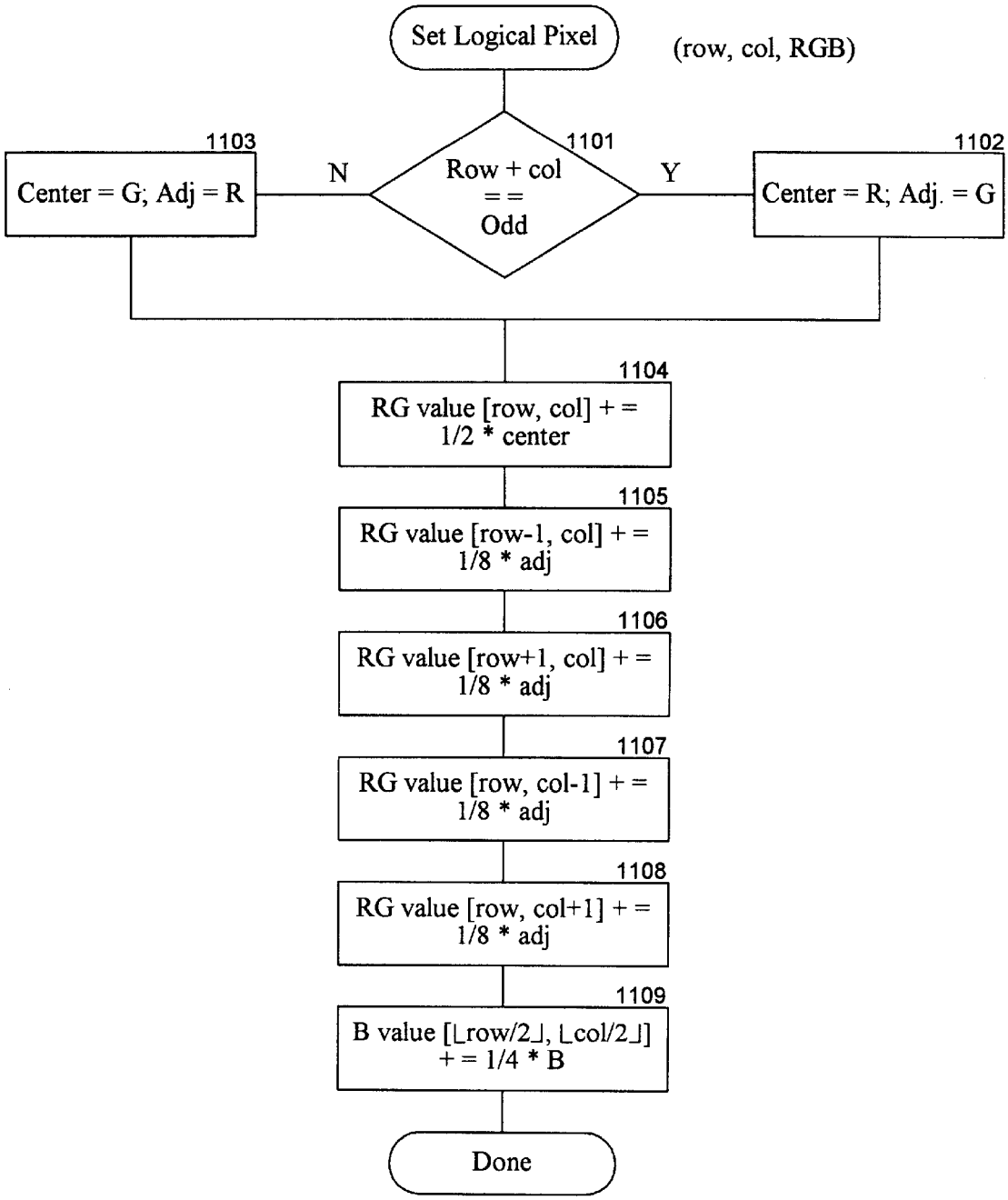
FIG. 11 is the flow diagram illustrating an algorithm for setting the intensity values for sub-pixels of a Pentile matrix without frame rate control.

FIG. 11 is a flow diagram illustrating an algorithm for setting the intensity values for sub-pixels of a Pentile matrix without frame rate control. Each logical pixel is identified by the row index and column index of its center sub-pixel (i.e., a red or green sub-pixel). In this example, the color of a logical pixel is provided by an RGB value with a depth of 8 bits. The illustrated algorithm contributes the intensity values for a single logical pixel. The algorithm may be performed for each logical pixel. In blocks 1101–1103, the algorithm initializes variables based on whether the center sub-pixel is red or green. In decision block 1101, if the center sub-pixel of the logical pixel is red, the algorithm continues at block 1102, else the algorithm continues at block 1103. With the described indexing technique, the sum of the row index and the column index of a red pixel is an odd number and of a green pixel is an even number. In block 1102, the algorithm sets a center intensity value to the intensity value of the red component and sets an adjacent intensity value to the intensity value of the green component of the logical pixel. In block 1103, the algorithm sets a center intensity value to the intensity value of the green component and sets an adjacent intensity value to the intensity value of the red component of the logical pixel. In block 1104, the algorithm adds to the RGvalue for the row and the column, ½ of the center intensity value. In block 1105, the algorithm adds to the RGvalue for the row minus 1 and the column, ⅛ of the adjacent intensity value. In block 1106, the algorithm adds to the RGvalue for the row plus 1 and the column, ⅛ of the adjacent intensity value. In block 1107, the algorithm adds to the RGvalue for the row and the column minus 1, ⅛ of the adjacent intensity value. In block 1108, the algorithm adds to the RGvalue for the row and the column plus 1, ⅛ of the adjacent intensity value. In block 1109, the algorithm adds to the Bvalue for the floor of the row divided by 2 and the floor of the column divided by 2, ¼ of the blue intensity value. The algorithm then completes.

Figure 12:
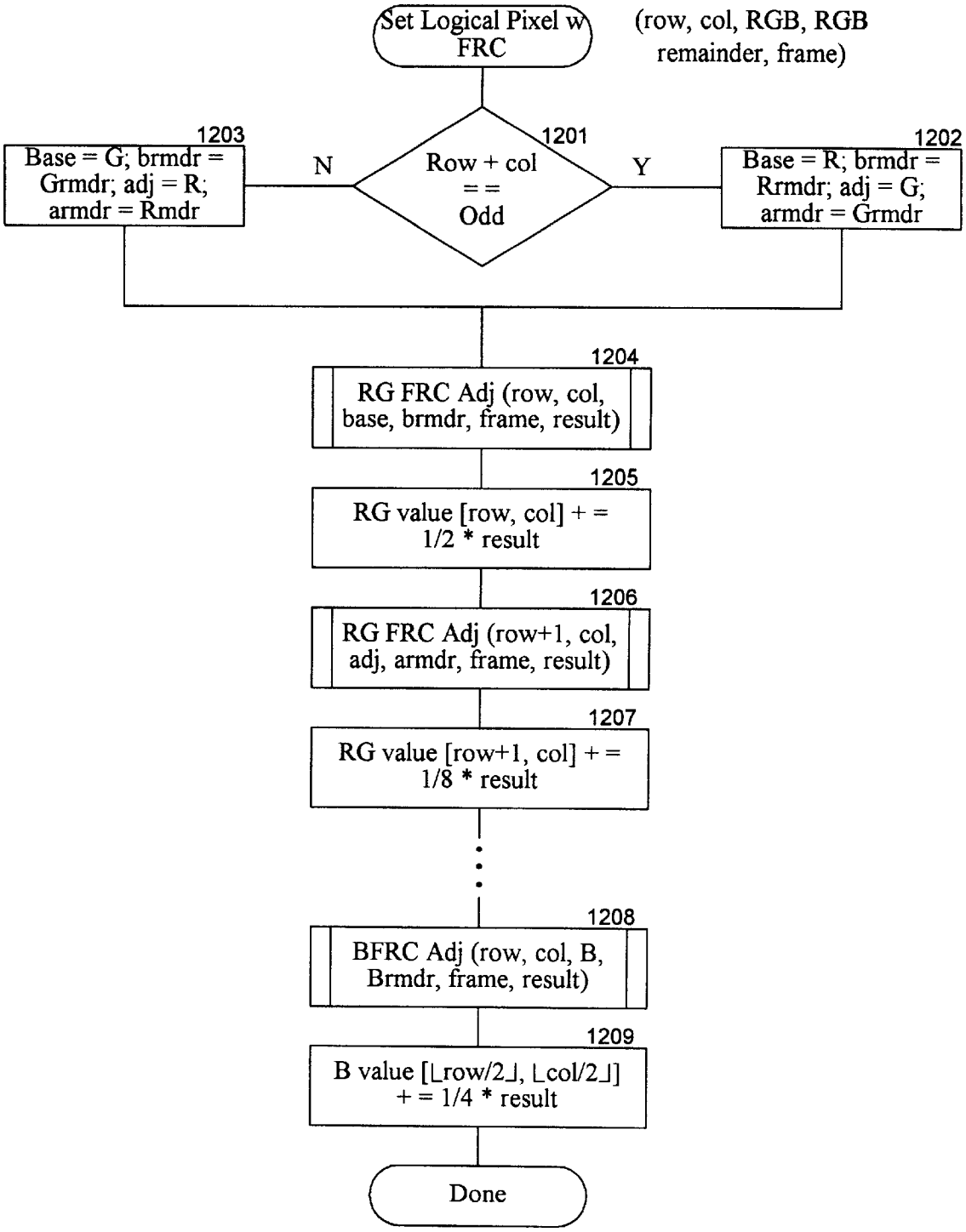
FIG. 12 is a flow diagram illustrating an algorithm for setting the intensity value for sub-pixels of a Pentile matrix with frame rate control in one embodiment.

FIG. 12 is a flow diagram illustrating an algorithm for setting the intensity value for sub-pixels of a Pentile matrix with frame rate control in one embodiment. The algorithm uses the row and column index of the logical pixel, the low-depth RGB value of the logical pixel, the RGB remainder, and an indication of the current frame number. In blocks 1201–1203, the algorithm sets variables depending on the color of the center pixel of the logical pixel. In decision block 1201, if the center pixel of the logical pixel is red, then the algorithm continues at block 1202, else the algorithm continues at block 1203. In block 1202, the algorithm sets a center intensity value to the intensity value of the red component, sets a center remainder value to the remainder value of the red component, sets an adjacent intensity value to the intensity value of the green component, and sets an adjacent remainder value to the remainder value of the green component. In block 1203, the algorithm sets a center intensity value to the intensity value of the green component, sets a center remainder value to the remainder value of the green component, sets an adjacent intensity value to the intensity value of the red component, and sets an adjacent remainder value to the intensity value of the red remainder. In block 1204, the algorithm invokes a routine to adjust the center intensity value based on frame rate control. The routine is passed an indication of the row and column index of the center sub-pixel, the center intensity value, the center remainder value, and the current frame number. The routine returns the result of adjusting the center intensity value for frame rate control. In block 1205, the algorithm then adds to the RGvalue for the row and the column, ½ of the resultant intensity value. In block 1206, the algorithm invokes a routine to adjust the adjacent intensity value for the sub-pixel above the center sub-pixel based on a frame rate control. In block 1207, the algorithm adds to the RGvalue for the row plus 1 and the column index, ⅛ of the resultant adjacent intensity value. The ellipsis indicates similar processing for each of the three other adjacent red or green sub-pixels. In block 1208, the component invokes a routine to calculate the adjusted intensity value based on frame rate control for the blue sub-pixel of the logical pixel. In block 1209, the algorithm adds to the Bvalue for the blue sub-pixel of the logical pixel, ¼ of the resultant intensity value. The algorithm then completes.

Figure 13:
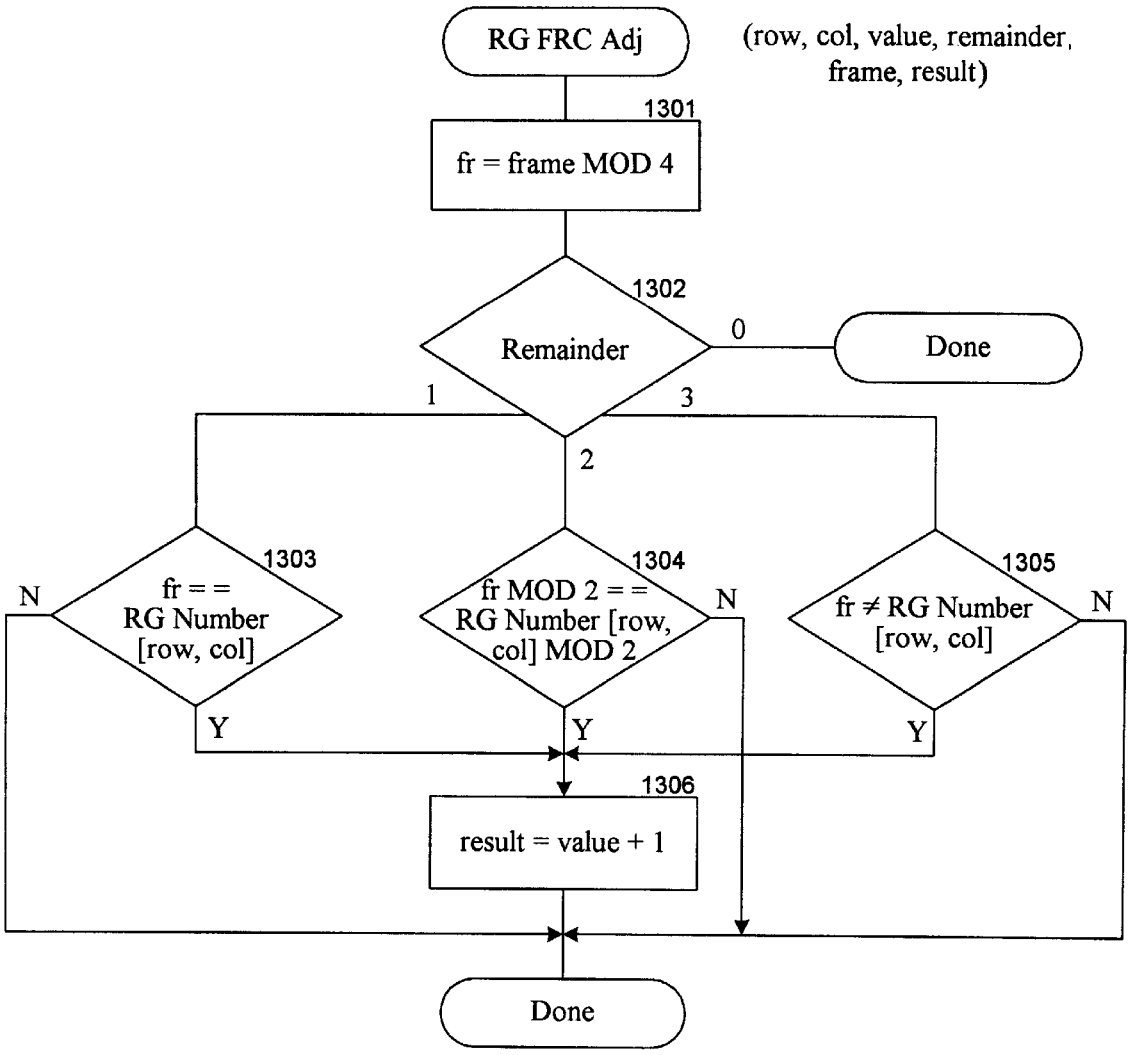
FIG. 13 is a flow diagram illustrating an algorithm that adjusts the intensity values for red and green sub-pixels using frame rate control in one embodiment.

FIG. 13 is a flow diagram illustrating an algorithm that adjusts the intensity values for red and green sub-pixels using frame rate control in one embodiment. (Although not shown, a similar routine may be used to adjust the intensity values of blue sub-pixels.) The routine is passed the row and column index of the corresponding sub-pixel, an intensity value, a remainder, and an indication of the current frame number. The routine returns the resultant intensity value. In block 1301, the routine calculates the remainder of the current frame number divided by four (e.g., frame number MOD 4). This assumes that the temporal dithering occurs over 4 frames. In decision block 1302, if the passed remainder is 0, then the routine sets the result to the intensity value and completes because the intensity value is not to be adjusted. If the passed remainder is 1, then the routine continues at block 1303. If the passed remainder is 2, then the routine continues at block 1304. If the passed remainder is 3, then the routine continues at block 1305. In decision block 1303, if the remainder of the current frame number is equal to the frame number of the sub-pixel (e.g., 1 out of 4 sub-pixels), then the routine sets the result to the intensity value plus 1 in block 1306 and completes. In decision block 1304, if the remainder of the remainder of the current frame number divided by 2 is equal to the remainder of the frame number for the sub-pixel divided by 2 (e.g., 2 out of 4 sub-pixels), then the routine sets the result to the intensity value plus 1 in block 1306 and then completes. In this example, when the remainder is 2, the sub-pixels with an odd frame number (e.g., 1 and 3) are adjusted when the current frame number is odd, and the sub-pixels with an even frame number (e.g., 2 and 4) are adjusted when the current frame number is even. Thus, 2 out of 4 sub-pixels are adjusted during every frame to effect spatial dithering, but a different 2 sub-pixels are adjusted from one frame to the next to effect temporal dithering. In decision block 1305, if the remainder of the current frame number is not equal to the frame number of the sub-pixel (e.g., 3 out of 4 sub-pixels), then the routine sets the result to the intensity value plus 1 in block 1306 and then completes.

From the foregoing, it will be appreciated that specific embodiments of the invention have been described herein for purposes of illustration, but that various modifications may be made without deviating from the spirit and scope of the invention. For example, the described techniques can be used with display devices of any type, such as liquid crystal displays and CRT display. The described techniques can be used with any type of display device with overlapping pixels such as a Pentile-based display device. One skilled in the art will appreciate that different contribution factors can be used depending on the characteristics of the display device and other factors. Accordingly, the invention is not limited except as by the appended claims.

We claim:

1. A method for establishing intensity values for a display device, the display device having sub-pixels, the sub-pixels forming overlapping logical pixels, each logical pixel having a center sub-pixel that is adjacent to multiple sub-pixels of the logical pixel, each sub-pixel for displaying red, green, or blue, the method comprising:

assigning a frame number to each sub-pixel, the frame number indicating when an intensity value for the sub-pixel is to be increased to effect dithering;

receiving an indication of a color to be displayed at each logical pixel, each color being represented by a red intensity value, a green intensity value, and a blue intensity value, each intensity value having a high depth;

mapping each high-depth intensity value to a low-depth intensity value and a remainder;

for each of a plurality of frames, for each of the logical pixels, for each of the sub-pixels of a logical pixel, retrieving the low-depth intensity value and remainder for the sub-pixel; and adjusting the retrieved low-depth intensity value based on a current frame number, the frame number assigned to the sub-pixel, and the retrieved remainder; and for each of the sub-pixels of the display device, combining the adjusted low-depth intensity values for the sub-pixels of the logical pixels to generate a final intensity value for the sub-pixel.

2. The method of claim 1 wherein the mapping includes mapping an 8-bit intensity value to a 6-bit intensity value.

3. The method of claim 1 wherein the remainder is equal the high-depth intensity value modulo the number of high-depth intensity values that map to each low-depth intensity value.

4. The method of claim 1 wherein the color is represented by an RGB value.

5. The method of claim 1 wherein the sub-pixels are arranged in a Pentile matrix.

6. A method in a system for generating intensity values for a display having sub-pixels, the method comprising:

receiving a color for a plurality of logical pixels of the display, the color having a high-depth intensity value for each component color, each logical pixel including sub-pixels, a sub-pixel being in multiple logical pixels;

mapping the high-depth component intensity value of each received color to a low-depth intensity value;

generating a sub-pixel intensity value for each sub-pixel of each logical pixel using frame rate control and the low-depth intensity values; and combining, for each sub-pixel of the display, the generated sub-pixel intensity values of the logical pixels to form the intensity value for the sub-pixel.

7. The method of claim 6 wherein the intensity values are generated for each of a plurality of frames and wherein the frame rate control generates the sub-pixel intensity value based on a frame number of the sub-pixel and a current frame number.

8. The method of claim 7 wherein each sub-pixel is provided with a pre-assigned frame number.

9. The method of claim 6 wherein the mapping generates a remainder for each low-depth intensity value and wherein the frame rate control sets each sub-pixel intensity value for a logical pixel to the corresponding component low-depth intensity value of the logical pixel adjusted based on a current frame number, a frame number of the sub-pixel, and the remainder for the component low-depth intensity value.

10. The method of claim 9 wherein the remainder is in a range of 0 to 3, wherein a modulo of the current frame number is in a range of 1 to 4, and wherein the frame number of a sub-pixel is in a range of 1 to 4, and including not adjusting when the remainder is 0.

11. The method of claim 9 wherein the remainder is in a range of 0 to 3, wherein a modulo of the current frame number is in a range 1 to 4, and wherein the frame number of a sub-pixel is in a range of 1 to 4 and including, when the remainder is 1, adjusting when the modulo of the current frame number is equal to the frame number of the sub-pixel.

12. The method of claim 9 wherein the remainder is in a range 0 to 3, wherein a modulo of the current frame number is in a range of 1 to 4, and wherein the frame number of a sub-pixel is in a range of 1 to 4, and including, when the remainder is 3, adjusting when the modulo of the current frame number is not equal to the frame number of the sub-pixel.

13. The method of claim 9 wherein the remainder is in a range 0 to 3, wherein a modulo of the current frame number is in a range of 1 to 4, and wherein the frame number of a sub-pixel is in a range of 1 to 4, and including, when the remainder is 2, adjusting so that the low-depth intensity values for half of the sub-pixels are adjusted every frame.

14. The method of claim 6 wherein each color includes multiple component intensity values.

15. The method of claim 14 wherein the component intensity values represent red, green, and blue.

16. The method of claim 6 wherein the combining of the sub-pixel intensity values includes summing the sub-pixel intensity values with a contribution factor applied to each sub-pixel intensity value.

17. The method of 16 wherein the contribution factor is 50% when the sub-pixel is a center sub-pixel of a logical pixel and wherein the contribution factor is 12.5% otherwise.

18. The method of claim 6 wherein the display is a Pentile-based display.

19. A dithering system for generating intensity values for a display having sub-pixels, comprising:

a component that provides intensity values for overlapping logical pixels of a display, each logical pixel including sub-pixels;

a component that assigns an intensity value to each sub-pixel of a logical pixel based on the provided intensity values using frame rate control; and a component that combines, for each sub-pixel of the display, the assigned intensity values of logical pixels to form a final intensity value for the sub-pixel.

20. The dithering system of claim 19 wherein the provided intensity values are derived from mapping high-depth intensity values to low-depth intensity values.

21. The dithering system of claim 20 wherein a remainder is provided for each low-depth intensity value.

22. The dithering system of claim 19 wherein frame rate control assigns intensity values based on a frame number of the sub-pixel and a current frame number.

23. The dithering system of claim 22 wherein each sub-pixel is provided with a pre-assigned frame number.

24. The dithering system of claim 19 wherein each logical pixel has an intensity value for a plurality of component colors.

25. The dithering system of claim 24 wherein the component colors are red, green, and blue.

26. The dithering system of claim 19 wherein the component that combines the assigned intensity values sums the assigned intensity values with a contribution factor applied to each assigned intensity value.

27. The dithering system of 26 wherein the contribution factor is 50% when the sub-pixel is a center sub-pixel of a logical pixel and wherein the contribution factor is 12.5% otherwise.

28. The dithering system of claim 19 wherein the display is a Pentile-based display.

29. A dithering system for generating intensity values for a display having sub-pixels, comprising:

means for providing intensity values for overlapping logical pixels of a display, each logical pixel including sub-pixels; and means for applying a temporal-spatial dithering technique and for combining intensity values of logical pixels to form a final intensity value for each sub-pixel of the display.

30. The dithering system of claim 29 wherein the temporal-spatial dithering technique is applied before the intensity values are combined.

31. The dithering system of claim 30 wherein the intensity values are mapped to lower-depth intensity values before the temporal-spatial dithering techniques is applied.

* * * * *